United States Patent [19]

Hedgepeth et al.

[11] 4,259,825

[45] Apr. 7, 1981

[54] FOLDABLE BEAM

[76] Inventors: Robert A. Frosch, Administrator of the National Aeronautics and Space Administration, with respect to an invention of John M. Hedgepeth, Santa Barbara, Calif.; John V. Coyner, Conifer, Colo.; Robert F. Crawford, Santa Barbara, Calif.

[21] Appl. No.: 14,663

[22] Filed: Feb. 23, 1979

[51] Int. Cl.[3] ..... E04H 12/18

[52] U.S. Cl. ..... 52/645

[58] Field of Search ..... 52/108, 109, 634–641, 52/632, 645, 646, 86, 648

[56] References Cited

U.S. PATENT DOCUMENTS

| | | | |
|---|---|---|---|
| 3,209,508 | 10/1965 | Hunnebeck | 52/632 |
| 3,312,020 | 4/1967 | Schuster | 52/108 |

FOREIGN PATENT DOCUMENTS

| | | | |
|---|---|---|---|
| 1052362 | 1/1944 | France | 52/86 |
| 122846 | of 0000 | United Kingdom | 52/86 |

*Primary Examiner*—James L. Ridgill, Jr.
*Attorney, Agent, or Firm*—Howard J. Osborn; John R. Manning

[57] ABSTRACT

The present invention is in the field of collapsible structural members. It discloses a foldable beam possessing superior qualities of: light weight, compactness for transportation, quick deployment with minimum use of force, and high strength. These qualities are achieved through the use of a series of longitudinally rigid segments, hinged along one side and threaded by one or two cables along the opposite side. Tightening the cables holds the beam extended. Loosening the cables permits the segments to fold away from the threaded side. In one embodiment the segments are connected by canted hinges with the result that the beam may be folded in a helix-like configuration around a cylinder. In another embodiment the segments themselves may be hinged to fold flat laterally as the beam is folded, resulting in a configuration that may be helixed around a shorter cylinder.

8 Claims, 6 Drawing Figures

FOLDABLE BEAM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; USC 2457).

BACKGROUND OF THE INVENTION

In many situations where trusses, girders, or beams are needed a conventional solid beam is unsuitable. It is essential that the structural member used be more lightweight, especially in those cases where transportation presents difficulties. It may be further desired that the element be collapsible to a compact size, and, finally, readily erectable upon arrival. These considerations are particularly crucial for operations in outer space, such as construction of antennae or space platforms. Transportation is feasible only for those materials which are lightweight and compact. The addition of each unit of mass or volume is extremely expensive. Whiles such a strong and rigid structure might be provided by a combination of rods and cables, the assembly of a structure in outer space poses such acute problems that preassembly is also necessary.

A prior art approach to this problem has been the use of semiflexible curved metal sections which can be flattened and rolled up without strain by a special reel, and which snap into a self-supporting configuration when let out. One such example is U.S. Pat. No. 3,503,164 which teaches a pair of semi-circularly curved sections joined by hinges along their lengths. Such an arrangement has the drawback of being heated on one side by the sun's rays and not on the other, causing it to bend. This problem can be avoided if the beam includes open spaces as in U.S. Pat. No. 3,564,789. Another problem remains; although strategic design of cross-braces and curved longerons yields a fairly high moment of inertia, the overall rigidity of the beam must be compromised by the requirement that the beam be pressed flat by the reeling mechanism.

Another attempt to provide a solution has been in the use of a set of semirigid rods, any one of which could be rolled up with the application of moderate force, as in U.S. Pat. No. 3,474,579. The set of rods, when disposed parallel to each other and in a common plane, can be rolled up by a force which is simply the force needed for one multiplied by the number of rods. When the plane of the rods is curved into a cylinder, the resulting moment of inertia is much greater. Nonetheless, considerable force is required to roll up such a structure.

It is thus seen that there remains a need for a structure featuring the required qualities of strength, light weight, and compactness as explained above, yet which can be deployed quickly and without the use of substantial force.

It is an object of the present invention to provide a more conveniently usable structural member.

It is a further object of the invention to provide a structural member which is strong, lightweight, and compact.

It is a further object of the invention to provide a structural member which can be reduced in one or more dimensions for transportation.

It is a further object of the invention to provide a structural member consisting of a series of longitudinally rigid segments which may be rotated or held fixed in relation to each other.

It is a further object of the invention to provide a structural member comprised of a series of segments wherein the segments are able to rotate relative to each other through the use of pivotal connections between the segments.

It is a further object of the invention to provide a structural member wherein the segments of the member may be held in fixed relation to each other by the use of a tensioning means.

It is a further object of the invention to provide a structural member which may be stowed for transportation by folding it around a cylinder.

It is a further object of the invention to provide a structural member which may be folded a multiplicity of times around a cylinder.

It is a further object of the invention to provide a structural member which may be stowed and deployed with a minimum use of force.

SUMMARY OF THE INVENTION

The foregoing and other objects are attainable according to the present invention by providing a strong, lightweight, foldable beam which can be deployed and refolded with a minimum use of force.

The invention consists of a series of rigid segments, hinged together along one side, and connected by one or more cables threaded through the side opposite the hinges. When the cable(s) are loosened, the beam is easily folded or wrapped around any suitable cylindrical core section available, and when the cable(s) are tightened, the segments are unwound into a straight or nearly straight line.

In one embodiment, the struts of individual segments of the beam are in fixed relation one to the others, and the hinges connecting the parallelogram-shaped side of the segments have their axes canted so that the beam, rather than folding in a plane to form the chords of a circle, folds instead in a helix-like configuration.

In another embodiment, the individual segments of the beam are hinged along an apex, and the opposite side through a scissors action is made to collapse as the beam is folded, resulting in a helix-like strip, the lateral dimension of which lays generally perpendicular to the surface of the cylinder. In this embodiment, the use of canted hinges is not essential, as the folded beam is nearly enough to flat to allow one revolution to overlay the preceeding one without undue twisting, if the radius of the core cylinder is sufficiently large. Nonetheless, the use of canted hinges would be helpful in this embodiment also.

The use of rigid segments provides a stronger beam than that of the prior art using members distorted through compression; the use of hinges allows the beam to be deployed with the minimum possible application of force, and in the latter mentioned embodiment the scissoring action of the cross-supports allows the beam to be collapsed to a very compact size.

Because the use of a pivot in place of a rigid connection may reduce the strength of some structures, the latter described flat-folding embodiment would be employed only where the premium on stowage space outweighed that on strength, and where there was ample stowage space the formerly described embodiment would be preferred.

A more complete appreciation of the invention and many of the attendant advantages thereof will be readily apparent as the same becomes better understood by reference to the following description when considered in connection with the accompanying drawings.

DETAILED DESCRIPTION OF THE DRAWINGS

Figure 1:
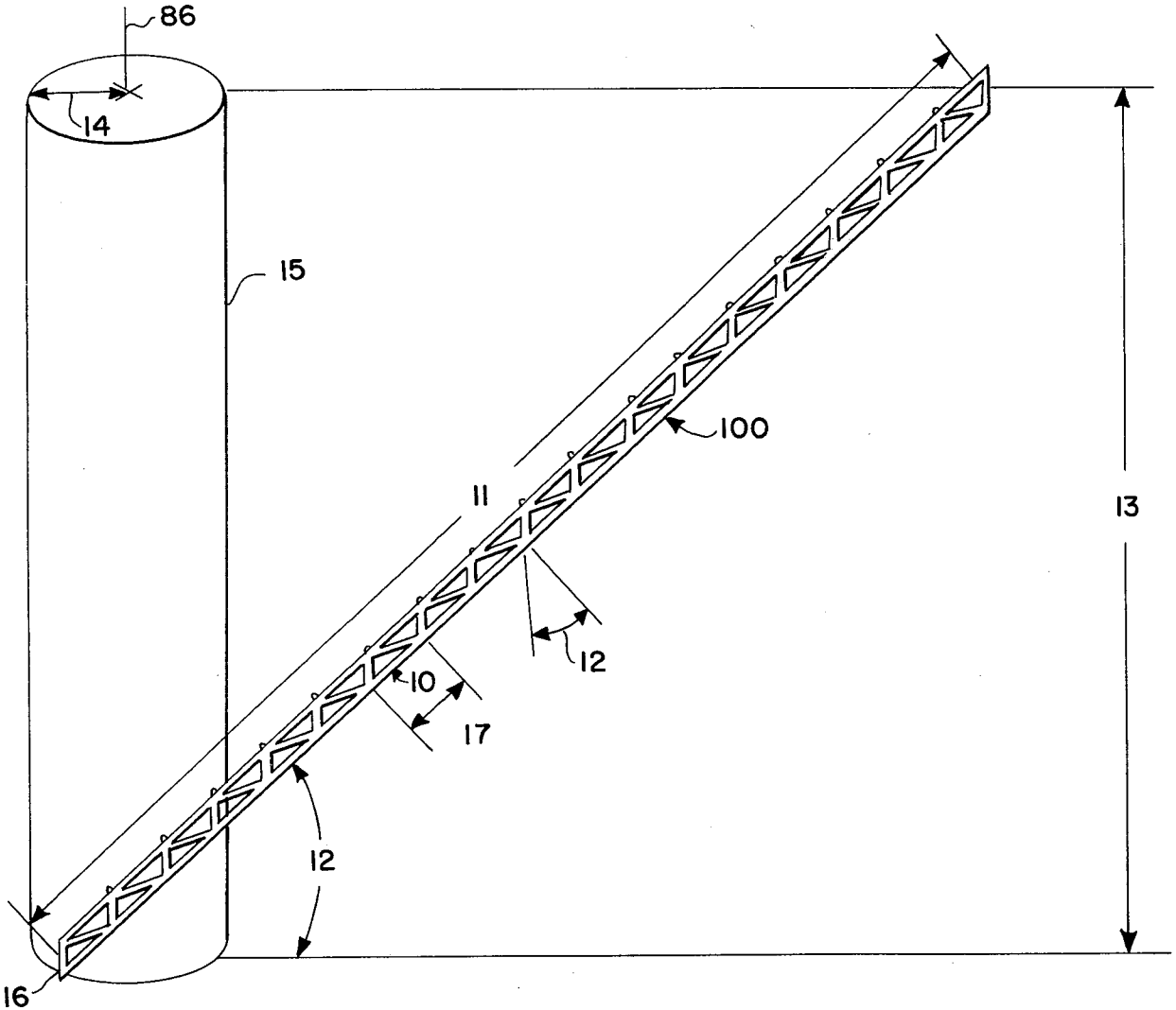
FIG. 1 shows the noncollapsing embodiment of the beam deployed and the cylinder around which it is to be folded.

FIG. 1 shows the canted-hinge, noncollapsing embodiment of the invention 100 in deployed position next to the cylinder 15 about which it is to be folded. The length 17 of a single rigid segment 10 of the beam, the length 11 of the entire beam, the angle of the hinge cant 12, the length 13 of the cylinder 15, the radius 14 of the cylinder 15 and the number of segments, are all interdependent. The following equations govern the relationship of these various dimensions:

$$\text{angle } 12 = \sin^{-1}\left(\frac{\text{cylinder length } 13}{\text{beam length } 11}\right)$$

$$\text{radius } 84 = \text{distance from cylinder axis } 86 \text{ to hinge axis } 85 \text{ of folded beam}$$

$$\text{segment length } 17 = \frac{2\sqrt{(\text{cylinder radius } 84)^2 - (\text{radius } 14)^2}}{\cos < 12}$$

$$\text{number of segments} = \frac{\text{beam length } 11}{\text{segment length } 17}$$

These equations having several degrees of freedom, it is evident that any of the dimensions may be varied by corresponding variations of other dimensions.

Figure 2:
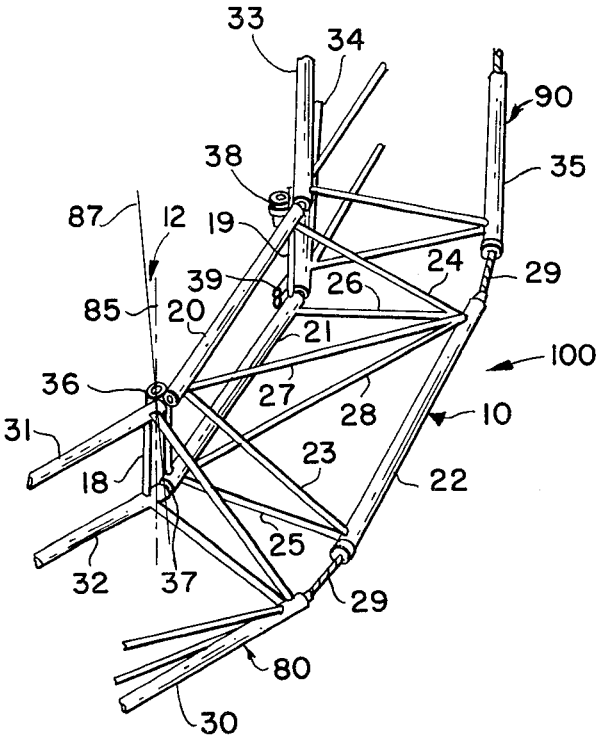
FIG. 2 is a detail of one and parts of adjacent segments of the noncollapsing embodiment of the beam in partially folded position.

A detail of segment 10 and portions of adjacent segments 80 and 90 are shown in FIG. 2. The segment consists of two longerons 20 and 21 which are connected to corresponding longerons 31 and 33, and 32 and 34, respectively, of the adjacent segments by hinges 36 and 37, and 38 and 39, respectively. Trusses 18 and 19 connect the longerons 20 and 21 to each other, and these four members together form a parallelogram. The leaves of any given hinge are each parallel to the longeron to which they are attached, and the hinge axis 85 is canted from the normal 87 to the axes of the longerons in the amount of angle 12.

Longerons 20 and 21 are connected by trusses 23 and 24, and 25 and 26, respectively, to a third longeron 22. Longerons 20 and 21 are also connected by diagonals 27 and 28, respectively, to longeron 22. A cable 29 is threaded through longeron 22. Application of tension to and resulting contraction of cable 29 from the attached end 16 of the beam causes segment 80 to pivot on hinges 36 and 37 until longeron 22 is abutted by the corresponding longeron 30 of segment 80. Segment 90 pivots likewise, as do all of the segments of the beam. Conversely, loosening cable 29 allows longerons 22,30, 35, etc. to separate and the segments to fold around the hinge axes. In order to effect the folding of the beam, the application of a moment around each hinge axis opposite that provided by contraction of the cable 29 is necessary. Neither the means for contracting the cable nor the means for applying the opposite moment are part of the present invention. These may be provided by any of a variety of means well known in the art. For instance, tension may be applied by taking in the cable on an electric winch. The cable might be held in its contracted position by the attachment of a collar at the terminal end of the beam to prevent it from sliding back into the longerons.

Figure 3:
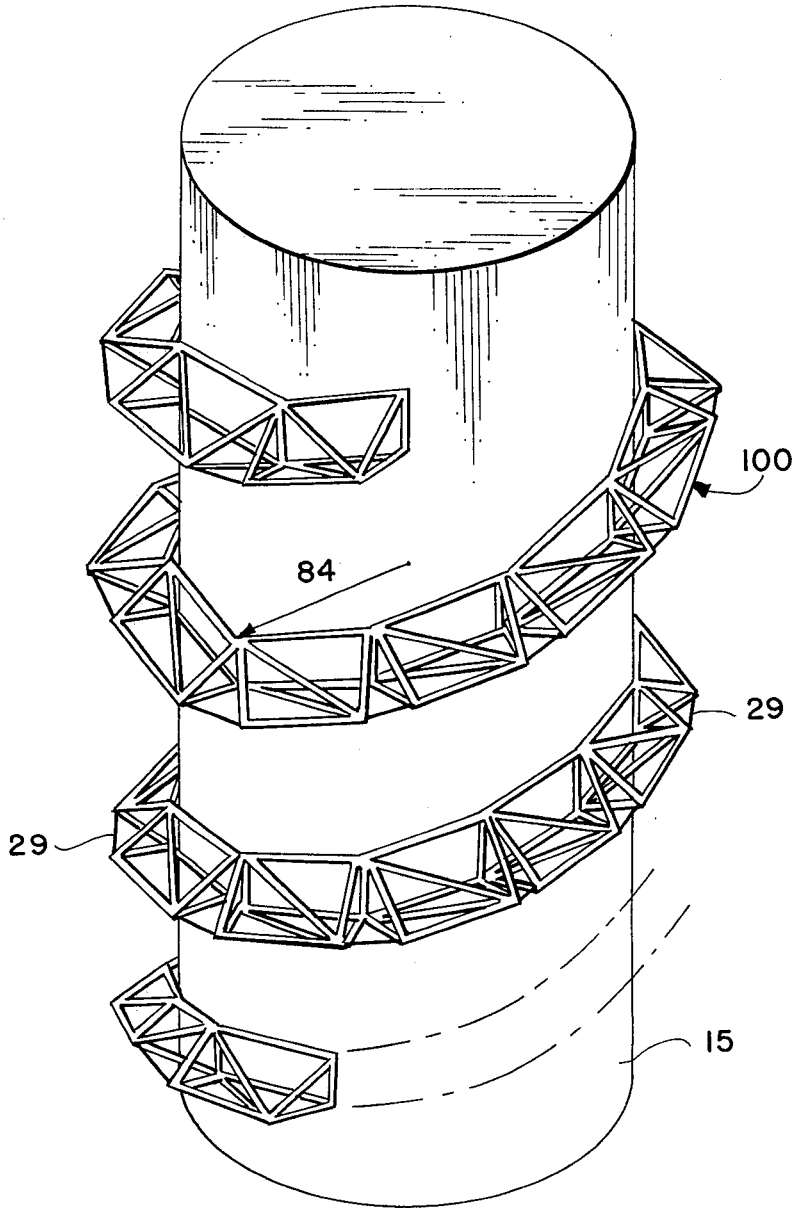
FIG. 3 shows the noncollapsing embodiment of the beam completely folded around the cylinder.

FIG. 3 shows the noncollapsing embodiment 100 of the beam fully folded around the cylinder core 15.

Figure 4:
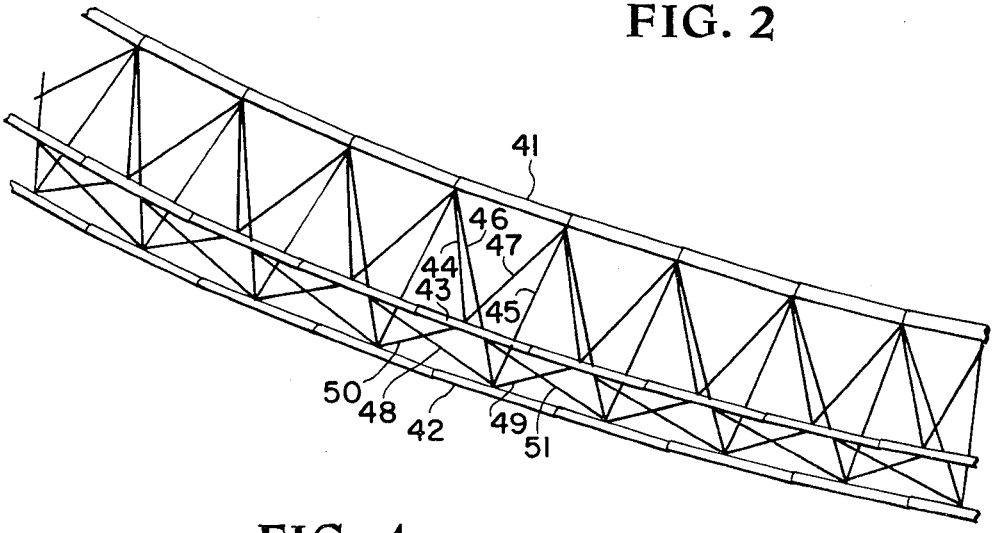
FIG. 4 shows an alternate embodiment of the invention wherein one side collapses as the beam is folded to form a flat, curved strip. In this view the beam is deployed.

FIG. 4 shows an alternative embodiment of the present invention incorporating a collapsing or flattening feature, allowing the beam to be folded and stowed around a cylinder of considerably less length than the cylinder of the formerly described embodiment. In this embodiment three longerons are used, and the resultant triangular beam 40 is hinged between one rather than two sets of longerons. In other words, the triangular beam folds around an apex rather than a base.

Figure 5:
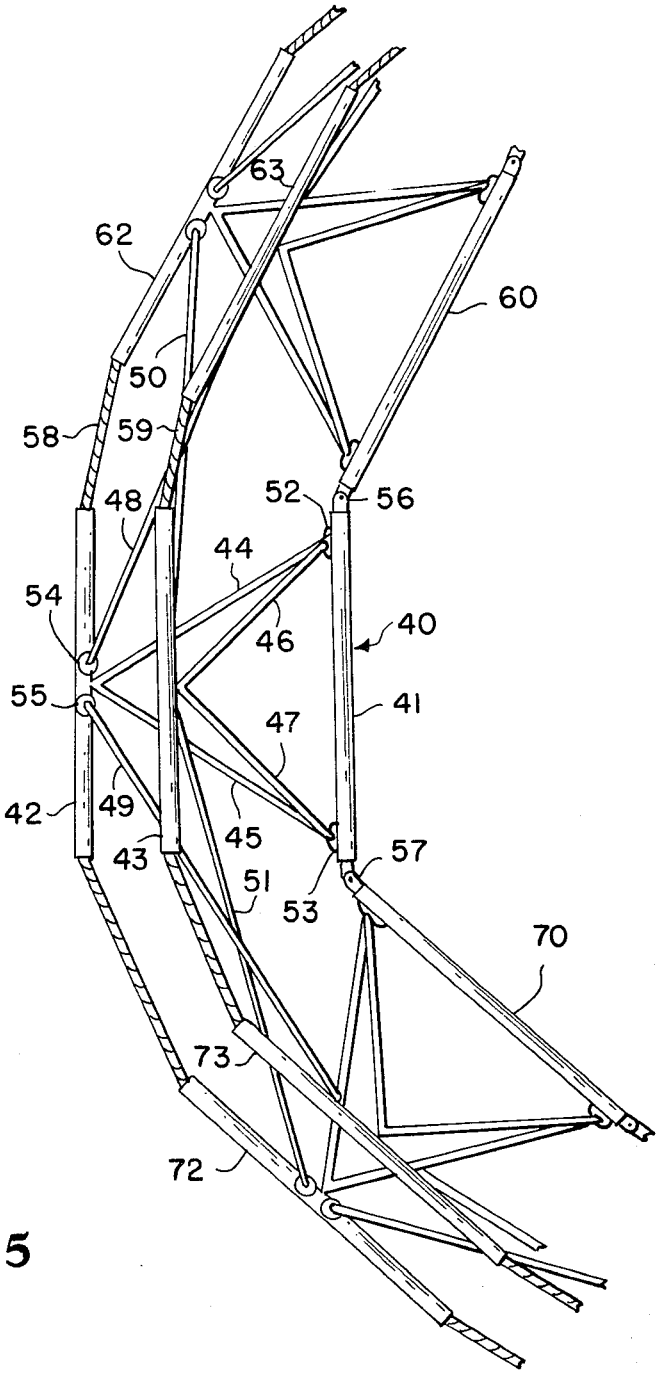
FIG. 5 shows the collapsing embodiment of the invention partially folded.

In FIG. 5 the beam is partially folded, exhibiting the functioning of the collapsing feature. Three segments, 40, 60 and 70 are shown. Segment 40, for example, consists of three longerons, 41, 42, and 43. Longeron 41 is connected by hinges 56 and 57 to segments 60 and 70, respectively. Longeron 41 is connected to longerons 42 and 43 by trusses 44 and 45, and 46 and 47, respectively. The trusses are fixedly connected to their respective longerons 42 and 43. The connection between longeron 41 and trusses 44 and 46, and 45 and 47, is by means of pivots 52 and 53, respectively. The manner of connection of the trusses to the longerons allows longerons 42 and 43 to rotate around longeron 41, moving toward and away from each other. The movement of longerons 42 and 43 is determined by diagonals 48 and 49, and 50 and 51, respectively. Longeron 42 is connected by diagonals 48 and 49 to alternate base longerons 63 and 73 of segments 60 and 70, respectively. Likewise, longeron 43 is connected by diagonals 50 and 51 to alternate base longerons 62 and 72 of segments 60 and 70, respectively. All of the connections to diagonals are by means of pivots, longeron 42 for example being connected by pivots 54 and 55 to diagonals 48 and 49, respectively. Longerons 62, 42, and 72 are threaded by cable 58, and longerons 63,43, and 73 are threaded by cable 59. When cables 58 and 59 are contracted, the segments turn on hinges 56 and 57, bringing the base longerons closer together. The presence of the diagonals, however, requires that a given base longeron remain separated from the alternate base longeron of the adjacent segment by the length of the diagonal connecting them. For example, longeron 42 swings through an arc relative to longeron 73. Hence, as the cable is contracted and the beam unfolds, the distance between the base longerons increases. Conversely, as the beam is refolded, the scissoring action of the diagonals brings the base longerons closer together.

Figure 6:
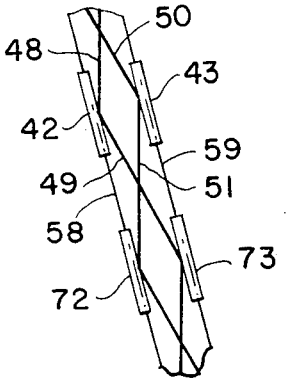
FIG. 6 shows a detail of one side of the collapsing embodiment of the invention, partially folded.

FIG. 6 is another detail showing only the base side of two segments of the beam.

Although the invention has been described relative to specific embodiments thereof, it is not so limited and numerous variations and modifications thereof will be readily apparent to those skilled in the art in the light of the above teaching. For example, while the beam has been described as straight in its deployed position, the same principle applies to a curved beam by making the hinged longerons shorter than the opposing, unhinged longerons.

What is claimed:

1. A foldable structural member comprising:

a plurality of longitudinal segments, each of said longitudinal segments having sides;

connector means connecting said longitudinal segments, said connector means arranged so that said connector means describe a planar configuration, when the longitudinal segments are deployed in a substantially straight line, and describe a cylindrical configuration, when the segments are folded into a helical configuration for stowage; and tensioning means associated with the sides of said member opposite said side having said connector means causing all of said segments to simultaneously pivot about the axes of said connector means from a stowed helical configuration into a deployed substantially straight line configuration, to be held deployed by said tensioning means.

2. The member of claim 1 wherein each of said longitudinal segments comprises a plurality of at least three equilength rigid, lightweight tubular longerons parallel to each other and reinforced by a plurality of trusses and diagonal members.

3. The member of claim 2 wherein at least two of said longerons are pivotally connected by rigid diagonals to the longerons of both of the adjacent longitudinal segments corresponding to the opposite of said longerons, whereby the contraction of said tensioning means and resultant approach of adjacent longitudinal segment forces the opposite sides apart and conversely the separation of said segments pulls the sides together in a scissor-like fashion.

4. The member of claim 2 wherein the said longerons comprising one of the said longitudinal segments are fixedly connected; and wherein the said connector means are disposed between two of the said longerons and each of the two corresponding longerons of adjacent longitudinal segments; and wherein the said tensioning means is threaded through others of the said longerons.

5. The member of claim 4 wherein said connector means is a plurality of hinges; said hinges having axes all of which, while remaining parallel to each other, are canted from the normal to the axes of the longerons which they connect, whereby the path formed by the folding of successive longitudinal segments approximates a helix, so that said member may be folded into multiple revolutions.

6. The member of claim 2 wherein said longerons are three in number, said connector means are disposed between one of the longerons and each of the corresponding longerons of adjacent longitudinal segments; and wherein the said tensioning means is threaded through the remaining two of the said longerons.

7. The member of claim 7 wherein:

the said two of the longerons with which the said tensioning means are associated have truss means pivotally connecting them to the said longeron having connector means associated therewith; and wherein the said two longerons are not directly connected to each other, but rather are pivotally connected by rigid diagonals to the longerons of both of the said adjacent longitudinal segments corresponding to the opposite of the said two longerons, whereby the contraction of the said tensioning means and resultant approach of adjacent longitudinal segments forces the opposite sides apart, and conversely, the separation of the longitudinal segments pulls the sides together.

8. The member of claim 7 wherein the said tensioning means is a cable.

* * * * *